US005184549A

United States Patent [19]

Imamaki et al.

[11] Patent Number: 5,184,549

[45] Date of Patent: Feb. 9, 1993

[54] STAMP DEVICE WITH A PRINTING ELEMENT, MOVABLE INK SUPPLYING DEVICE, AND PLATE MAKING DEVICE EMPLOYING AN ELONGATE HEAT SENSITIVE STENCIL PAPER

[75] Inventors: Teruo Imamaki, Kasugai; Tetsuji Fuwa, Hashima; Takashi Miki, Nagoya, all of Japan

[73] Assignee: Brother Kogyo Kabushiki Kaisha, Nagoya, Japan

[21] Appl. No.: 812,107

[22] Filed: Dec. 23, 1991

[30] Foreign Application Priority Data

| | | | |
|---|---|---|---|
| Dec. 29, 1990 | [JP] | Japan | 2-417189 |
| Mar. 4, 1991 | [JP] | Japan | 3-10942[U] |
| Mar. 6, 1991 | [JP] | Japan | 3-11779[U] |

[51] Int. Cl.[5] ..... B41K 1/32

[52] U.S. Cl. ..... 101/121; 101/125; 101/128.21

[58] Field of Search ..... 101/125, 128.4, 128.21, 101/121, 122, 405, 327; 400/136

[56] References Cited

U.S. PATENT DOCUMENTS

| | | | |
|---|---|---|---|
| 1,601,831 | 10/1926 | Inglesby | 101/121 |
| 2,499,472 | 3/1950 | Dyal | 101/121 |
| 2,884,853 | 5/1959 | Cantoni | 101/121 X |
| 3,799,053 | 3/1974 | Rabelow | 101/125 |
| 4,203,362 | 5/1980 | Underwood et al. | 101/405 X |
| 4,594,943 | 6/1986 | Nettesheim et al. | 101/405 X |
| 4,957,378 | 9/1990 | Shima | 400/136 X |

FOREIGN PATENT DOCUMENTS

| | | | |
|---|---|---|---|
| 0130612 | 1/1985 | European Pat. Off. . | |
| 3806356A1 | 6/1988 | Fed. Rep. of Germany . | |
| 692160 | 10/1930 | France . | |
| 2405135 | 9/1978 | France . | |
| 54-9523 | 4/1979 | Japan . | |
| 0048398 | 3/1985 | Japan | 101/128.4 |
| 60-180891 | 1/1986 | Japan . | |
| 63-11855 | 1/1988 | Japan . | |
| 107403 | 1/1925 | Switzerland . | |

*Primary Examiner*—Clifford D. Crowder
*Attorney, Agent, or Firm*—Oliff & Berridge

[57] ABSTRACT

A compact portable stamp device which can prevent the ink stains on an operator and his/her clothes and the occurrence of nonuniform printing and, further, simplifies the operation of changing the color of the ink. The stamp device comprises a heat sensitive stencil paper fed between first and second rollers. The heat sensitive stencil paper has a laminate structure including a thermoplastic film layer and a porous carrier layer. The stamp device has a stencil paper feeding unit for drawing the heat sensitive stencil paper from the first roller and winding the heat sensitive stencil paper around the second roller, and elastic ink impregnated member, provided in the feed path of the heat sensitive stencil paper between the first and second rollers, and a moving unit for moving the ink impregnated member between a first position where the ink impregnated member is separate from the heat sensitive stencil paper and a second position where the ink impregnating member is in close contact with the heat sensitive stencil paper. The ink impregnating member is brought into close contact witht the heat sensitive stencil paper to exude ink from the ink impregnated member through a perforated portion of the thermoplastic film thereby transferring an image onto a printing paper.

24 Claims, 20 Drawing Sheets

STAMP DEVICE WITH A PRINTING ELEMENT, MOVABLE INK SUPPLYING DEVICE, AND PLATE MAKING DEVICE EMPLOYING AN ELONGATE HEAT SENSITIVE STENCIL PAPER

BACKGROUND OF THE INVENTION

1. Field of the Invention

The invention relates to a stamp device employing an elongated heat sensitive stencil paper capable of being perforated by heat and, more particularly, to a compact portable stamp device which records a stamp image on a medium with an ink through the elongated heat sensitive stencil paper previously perforated by heat using a thermal head.

2. Description of the Prior Art

There is known a compact portable stamp device employing a stencil paper having a perforation pattern formed of characters, figures, and/or symbols that are drawn using a pencil or a ball-point pen. Such a stamp device, as disclosed in U.S. Pat. No. 3,799,053 (Japanese Examined Patent Publication No. 54-9523), for example, includes a table and an inking unit. In this stamp device, the inking unit is mounted to reciprocate relative to the table and the stencil paper is mounted on the inking unit. When the inking unit is positioned at one end of a reciprocating stroke, mimeograph printing is carried out, and when the inking unit is positioned at the other end of the surface, the stamp device is accommodated in the table.

However, in the stamp device disclosed in U.S. Pat. No. 3,799,053, when exchanging the stencil paper, the operator's hands or clothes are often stained by the ink. Further, the ink cannot be replaced by another ink having a different color.

Also known is a heat sensitive stencil paper which can be perforated by infrared irradiation or heat of a thermal head to form a pattern of characters or the like. In particular, a typical example of such a heat sensitive stencil paper is formed by bonding a thermoplastic film and a porous thin paper to each other with use of an adhesive. A compact portable stamp device employing such a heat sensitive stencil paper is disclosed in Japanese Utility Model Laid-open Publication No. 63-11855, for example. In this stamp device, a mimeograph printing plate is detachably attached to a base including a grip portion, a cushion layer, and a cohesive layer. The mimeograph printing plate has a three-layer structure consisting of a perforated stencil paper, a frame, and a cover sheet having an ink impermeability. Ink is applied or placed in a space between the stencil paper and the cover sheet by the frame. In this stamp device, mimeograph printing can be effected by attaching the mimeograph printing plate having a perforated pattern of desired characters, figures, and/or symbols to the base and pressing the mimeograph printing plate against a printing paper.

In the stamp device disclosed in Japanese Utility Model Laid-open Publication No. 63-11855, the operator's hands or clothes are less likely to be stained with ink as compared with the former prior art. However, the ink must be manually applied potentially causing the ink layer thickness to be nonuniform. As a result, nonuniformity of print occurs.

SUMMARY OF THE INVENTION

The invention addresses and solves the above problems. Thus, it is an object of the invention to provide a compact portable stamp device which can prevent stains by the ink and the occurrence of nonuniformity of print and to simplify the operation of changing the ink color.

Another object of the invention is to provide a compact portable stamp device which records a stamp image on a medium with an ink through a previously perforated elongated heat sensitive stencil paper.

A further object of the invention is to provide a compact portable stamp device which records a stamp image on a medium with an ink through an elongated heat sensitive stencil paper previously perforated by heat of a thermal head.

The stamp device employing a heat sensitive stencil paper which has a pattern of pores formed by application of heat, comprising:

an elongated heat sensitive stencil paper having an end wound around a first roller and a lead end for winding around a second roller;

stencil paper feeding unit for drawing the heat sensitive stencil paper from the first roller and feeding the heat sensitive stencil paper to the second roller, the stencil paper feeding unit for feeding the pattern of pores of the heat sensitive stencil paper to a position between the first and second rollers;

an ink supplying unit for supplying an ink to the pattern of pores of the heat sensitive stencil paper, the ink supplying unit being provided in a feeding path of the heat sensitive stencil paper between the first and the second rollers; and a moving unit for moving the ink supplying unit between a first position where the ink supplying unit is separated from the heat sensitive stencil paper and a second position where the ink supplying unit is in close contact with the pattern of pores of the heat sensitive stencil paper.

In the stamp device having the above structure, when the pattern of pores of the heat sensitive stencil paper, produced where the heat is applied by the thermal head, is fed to a position between the first roller and the second roller, the ink supply unit is disposed in the first position where it is separated from the heat sensitive stencil paper. Then, the ink supplying unit is moved to the second position by the moving unit so as to be pressed against the heat sensitive stencil paper. As a result, the ink in the ink supply unit penetrates the pores of the thermoplastic film to transfer the pattern image onto the printing paper.

Therefore, it is unnecessary for an operator to apply ink and the operator's hands or clothes are not stained by the ink. Furthermore, as the ink impregnating member is elastic, uniform printing can be effected even if a printing surface is uneven. Additionally, color change of the ink can be simply carried out in the first position where the ink impregnated supplying member is separate from the stencil paper and can be easily replaced.

BRIEF DESCRIPTION OF THE DRAWINGS

The above and other objects, features and advantages of the invention will become more apparent from the following description taken in connection with the accompanying drawings, in which.

DESCRIPTION OF THE PREFERRED EMBODIMENTS

Preferred embodiments of the invention will now be described with reference to the drawings.

Figure 1:
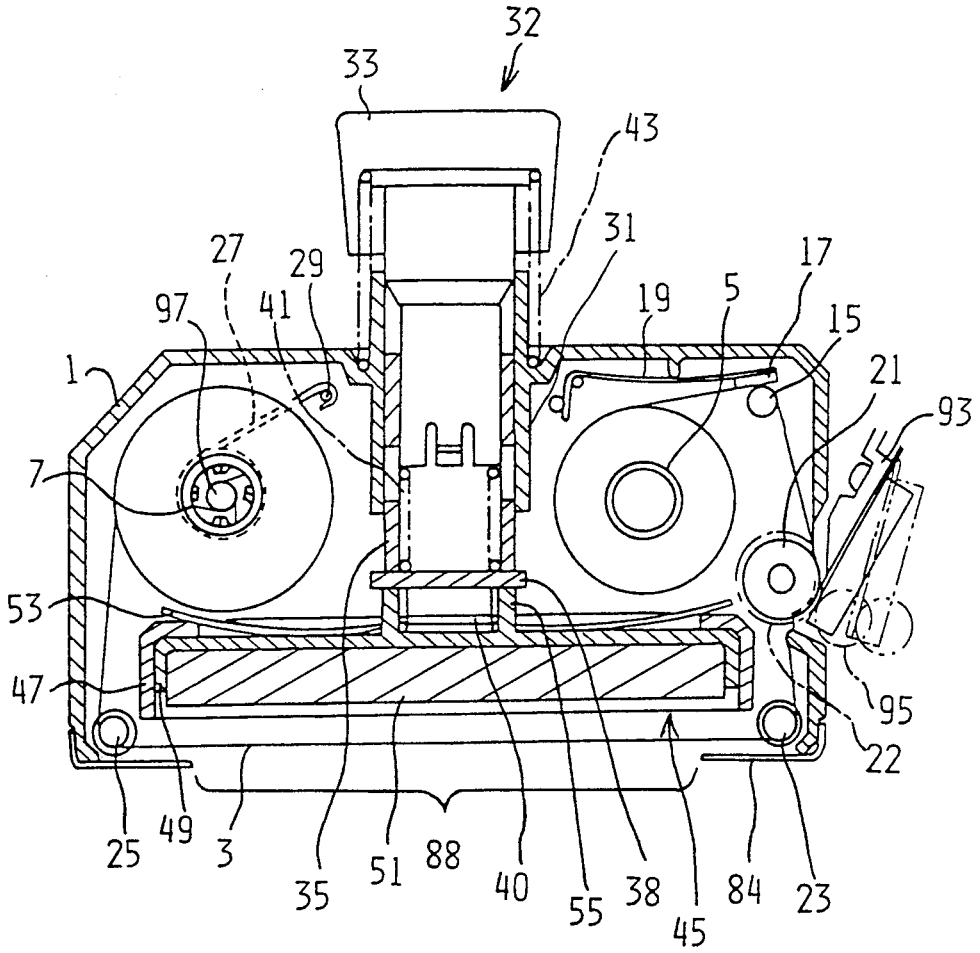
FIG. 1 is a side elevation in vertical section of the printing element of the stamp device according to a preferred embodiment illustrating the position where the ink impregnating member is separate from the heat sensitive stencil paper.

FIG. 1 is a vertical sectional view of a printing element of a stamp device according to the preferred embodiment, showing the ink impregnating member in a first position where it is separate from the heat sensitive stencil paper. The printing element is generally constructed so that a heat sensitive stencil paper (which will be hereinafter referred simply to as a stencil paper) 3 rolled at both its ends, is accommodated in a housing 1. The right end of the stencil paper 3, as viewed in FIG. 1, is wound around a supply spool 5 which functions as a first roller and the left end of the stencil paper 3 is wound around a take-up spool 7 which functions as a second roller. The supply spool and the take-up spool 7 are rotatably supported to the housing 1.

Figure 3:
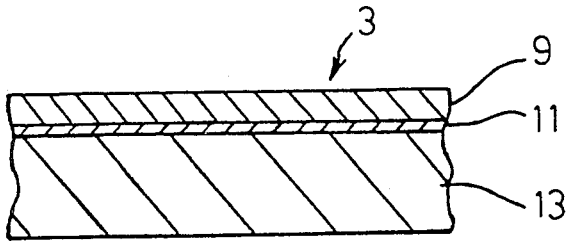
FIG. 3 is a sectional view of the heat sensitive stencil paper.

As shown in FIG. 3, the stencil paper 3 has a laminate structure formed by bonding a thermoplastic film 9 and a porous carrier 13 to each other using an adhesive layer 11. In this preferred embodiment, the thermoplastic film 9 is formed from a polyethylene terephthalate film (which will be hereinafter referred to simply as a PET film) having a thickness of about 2 microns. However, the film may be made of any suitable thermoplastic material such as polypropylene or vinylidene chloride-vinyl chloride copolymer. The thickness of the PET film is preferably in the range of 1 to 4 microns. If the thickness is less than 1 micron, the manufacturing cost becomes high and the strength becomes low, resulting in no significant practical use. In contrast, if the thickness is more than 4 microns, it is too thick to perforate the film with a thermal head having a rated power of about 1 millijoule per dot.

The porous carrier 13 in this preferred embodiment is formed from a porous thin sheet of paper made primarily of a natural fiber such as Manila hemp, kozo or mitzumata; a synthetic fiber such as PET, polyvinyl alcohol or polyacrylonitrile; or a semisynthetic fiber such as rayon. The thickness of the porous carrier 13 is about 40 microns and is preferably in the range of 20 to 100 microns. The stencil paper 3 having the above structure is wound in such a manner that the thermoplastic film 9 is directed to the outside of the housing 1 as viewed in FIG. 1.

A feeding path of the stencil paper 3 is described with reference to FIG. 1. The stencil paper 3 is drawn from the supply spool 5 and is fed to a cylindrical boss 15 integrally formed with the housing 1. A leaf spring 19, having a felt 17 at one end thereof, is provided above the cylindrical boss 15. The leaf spring 19 is bent at its other end to form an L-shaped portion which is supported to the housing 1. The leaf spring 19 is normally elastically deformed so that the felt 17 provided at the one end of the leaf spring 19 normally presses the cylindrical boss 15 through the stencil paper 3 passing therebetween. The felt 17 and the leaf spring 19 function as tension applying member. Accordingly, a predetermined frictional force is normally applied to the stencil paper 3 passing between the felt 17 and the cylindrical boss 15.

The stencil paper 3, drawn between the felt 17 and the cylindrical boss 15, is fed to the take-up spool 7 through a paper guide which is formed by a platen 21, a guide roller 23, and a guide roller 25 and is wound around the take-up spool 7. A torsion coil spring 27 is wound at its one end portion around the take-up spool 7 and an arm portion formed at the other end of the torsion coil spring 27 is engaged with a shaft 29 integrally formed with the housing I. The torsion coil spring 27 is wound around the take-up spool 7 in such a manner that the torsion coil spring 27 is slackened in association with clockwise rotation of the take-up spool 7, as viewed in FIG. 1, while being tightened in association with counterclockwise rotation of the take-up spool 7. Accordingly, when the take-up spool 7 is rotated in a winding direction of the stencil paper 3 (clockwise direction), the load applied to the take-up spool 7 by the torsion coil spring 27 is small, while when the take-up spool 7 is rotated in an unwinding direction of the stencil paper 3 (counterclockwise direction), the load applied to the take-up spool 7 by the torsion coil spring 27 is very large.

Figure 2:
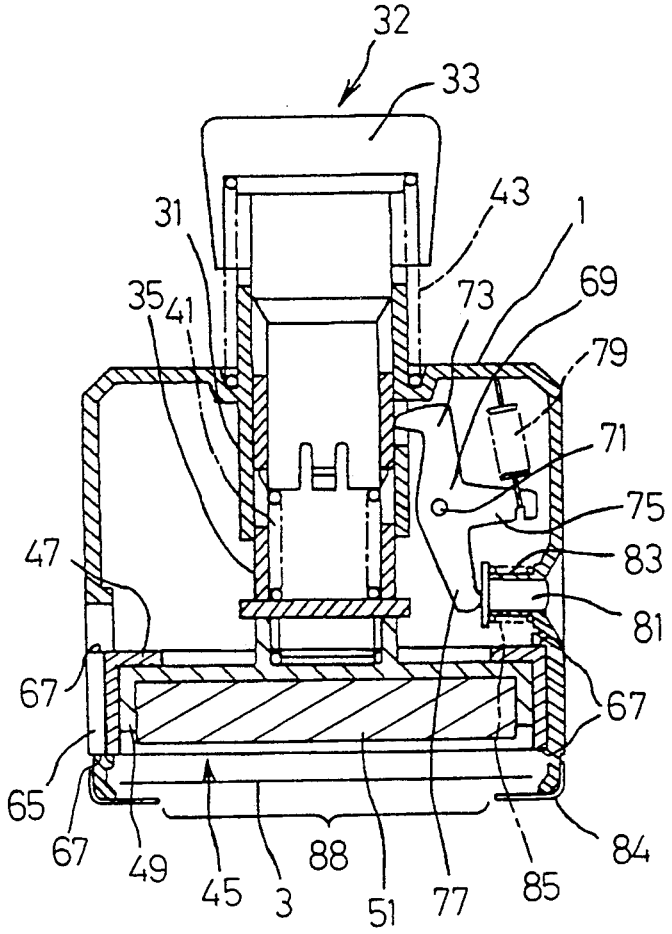
FIG. 2 is a front elevation in vertical section of the printing element shown in FIG. 1.

The platen 21 is rotatably supported to the housing 1. A platen driving gear 22 is mounted on one end of the platen 21, so that a driving torque is transmitted through the platen driving gear 22 to the platen 21. A cylindrical guide 31 is integrally formed with the housing 1, at an upper middle portion of the housing 1, and extends both upwardly and downwardly from the upper middle portion thereof along the vertical direction (as viewed in FIG. 1). A grip unit 32 which functions as a moving means, is vertically slidably inserted in the cylindrical guide 31. One portion of the cylindrical guide 31 has an opening, as shown in FIG. 2, that is engaged by a first arm 73 of a latch 69 described below.

Figure 4:
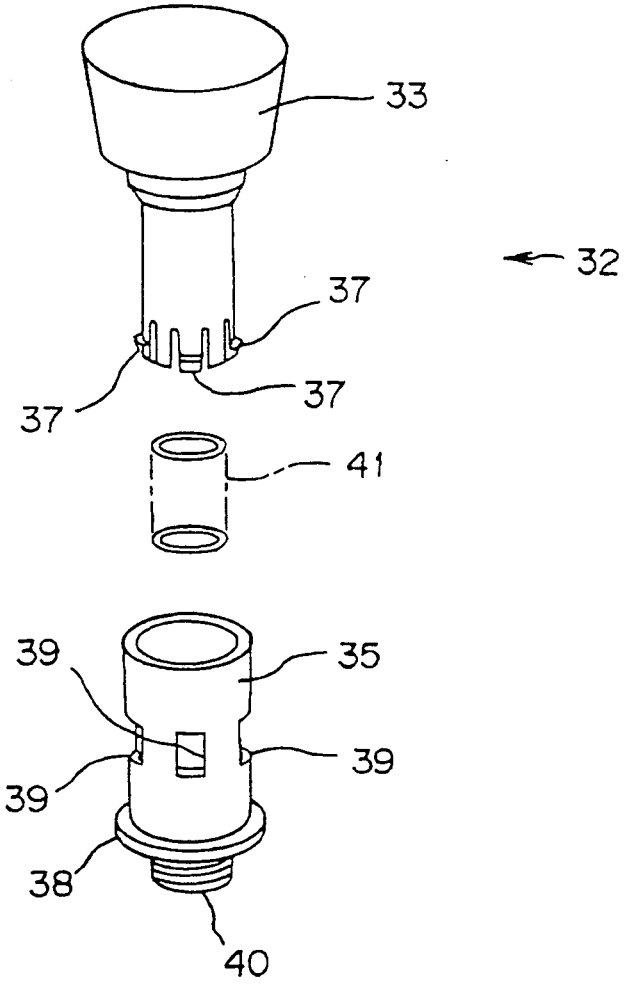
FIG. 4 is an exploded perspective view of the grip unit.

As shown in FIG. 4, the grip unit 32 comprises a grip portion 33, a cylindrical member 35 for being engaged with the grip portion 33, and a compression coil spring 41 which is disposed between the cylindrical member 35 and the grip portion 33 along the vertical direction. The grip portion 33 is formed in a stepped shape along the vertical direction such that a diameter thereof is stepwise reduced toward its lower end portion which is inserted into the cylindrical member 35. The lower end of the grip portion 33 is circumferentially divided to form a plurality of tongue portions. Four of the tongue portions are provided with outwardly projecting pawls 37, respectively. The cylindrical member 35 is provided with four axially elongated holes 39 adapted to respectively engage the four pawls 37 of the grip portion 33. Accordingly, when the grip portion 33 is inserted into the cylindrical member 35, the four pawls 37 of the grip portion 33 are brought into engagement with the four holes 39 of the cylindrical member 36, respectively.

The cylindrical member 35 is provided at its lower end portion with a flange 38 and an external thread portion 40 below the flange 38. The compression coil spring 41 is interposed between the grip portion 33 and the cylindrical member 35, so as to generate an upward biasing force against the grip portion 33 to move the upper part of the grip portion 33 away from where its lower part enters the cylindrical member 35. The biasing force of the compression coil spring is set to a value such that the pawls 37 are not deformed by creep deformation. Therefore, there is no possibility that the grip portion 33 totally separates from the cylindrical member 35.

In the grip unit 32 having the above described structure, relative rotation of the grip portion 33 and the cylindrical member 35 around the vertical direction is inhibited, and relative axial movement of the grip portion 33 and the cylindrical member 35 along the vertical direction is permitted because of the engagements between the pawls 37 of the grip portion 33 and the holes 39. That is, the grip portion 33 and the cylindrical member 35 can be relatively axially moved by a given stroke corresponding to an axial gap between each pawl 37 and the respective hole 39 engaging therewith by depressing the grip portion 33 and the cylindrical member 35 against the biasing force of the compression coil spring 41. As shown in FIG. 1, another compression coil spring 43 is provided between the grip unit 32 and the housing 1 so that the grip unit 32 is normally upwardly biased by the compression coil spring 43.

Figure 5:
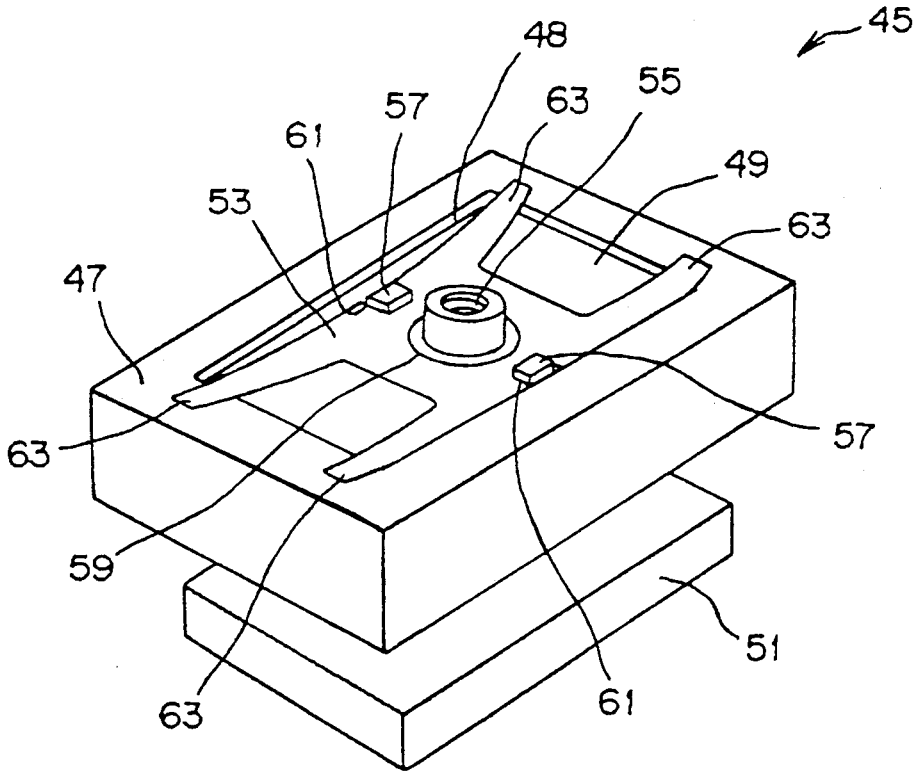
FIG. 5 is a perspective view of the ink pad unit.

An ink pad unit 45, which functions as ink supplying unit, is provided under the grip unit 32 such that the ink pad unit 45 is coupled to the cylindrical member 35 of the grip unit 32. As shown in FIG. 5, the ink pad unit 45 comprises an ink pad cartridge 47, an ink pad holder 49 mounted in the ink pad cartridge 47, an ink pad 51, as an ink impregnating member, bonded to the ink pad holder 49, and a leaf spring 53 mounted on the ink pad holder 49 for pressing the ink pad holder 49 upwardly. The ink pad 51 is formed of a porous elastic material capable of holding the ink. An upper surface of the ink pad 51 is fixedly bonded to the ink pad holder 49 by an adhesive.

The ink pad holder 49 is formed in a box-like shape. An upper surface of the ink pad holder 49 is integrally formed with an internal thread portion 55 adapted to engage with the external thread portion 40 of the cylindrical member 35. The upper surface of the ink pad holder 49 is further integrally formed with two pawls 57. The ink pad cartridge 47 is also formed in a box-like shape. An upper surface of the ink pad cartridge 47 is formed with a rectangular through hole 48. An internal size of the ink pad cartridge 47 is so set as to just accommodate the ink pad holder 49. The leaf spring 53 is formed in a substantially H-shaped configuration and is provided at its central portion with a through hole 59 for receiving the internal thread portion 55 of the ink pad holder 49 and is provided with two recesses 61 for respectively engaging the two pawls 57 of the ink pad holder 49. The leaf spring 53 has four arms 63. A length of the leaf spring 53 extending in the direction of the four arms 63 is set to be larger than that of the through hole 48 of the ink pad cartridge 47 in a longitudinal direction thereof. The central portion of the leaf spring 53 is mounted on the ink pad holder 49 by engaging the two recesses 61 of the leaf spring 53 with the two pawls 57 of the ink pad holder 49, and the four arms 63 of the leaf spring 53 resiliently abut against the upper surface of the ink pad cartridge 47. Accordingly, the upper surface of the ink pad holder 49 is normally pressed against the ink pad cartridge 47 by the spring force of the leaf spring 53, so that the ink pad 51 is normally received in the ink pad cartridge 47 so as not to project out of the ink pad cartridge 47 (see FIG. 1).

As shown in FIG. 2, a side wall of the housing I is formed with an opening 65 through which the ink pad unit 45 is to be inserted into the housing 1. When the ink pad unit 45 is inserted in the housing 1, the ink pad cartridge 47 is guided by guide grooves 67 so as to be held in a fixed position in the housing 1. Further, the internal thread portion 55 of the ink pad holder 49 is detachably engaged with the external thread portion 40 of the cylindrical member 35. Accordingly, the ink pad holder 49 is vertically movable in the ink pad cartridge 47 in association with vertical movement of the grip unit 32.

As shown in FIG. 2, a latch 69 is provided in the housing 1. The latch 69 is rotatably supported to a shaft 71 integrally formed with the housing 1. The latch 69 has three arms, that is, a first arm 73 abutting against the cylindrical member 35 through opening in the cylindrical guide 31, a second arm 75 engaged with one end of a tension coil spring 79, and a third arm 77 abutting against a button key 81.

The first arm 73 and the opening in the cylindrical guide 31 function as retaining means for retaining ink pad unit 45 in the second position where the ink pad 51 is in close contact with the stencil paper 3, and the button key 81 functions as a releasing means for releasing the first arm 73 of the latch 69 from the opening in the cylindrical guide 31 as described below.

The other end of the tension coil spring 79 is connected to the housing 1 so that the latch 69 is normally biased in a counterclockwise direction, as viewed in FIG. 2, by the spring force of the tension coil spring 79. The button key 81 is axially slidably supported to a guide groove 83 integrally formed with the housing A compression coil spring 85 is interposed between a flange portion formed at one end of the button key 81 and the housing 1, so that the flange portion of the button key 81 is biased by the spring force of the compression coil spring 85 to abut against the third arm 77 of the latch 69. The spring force of the tension coil spring 79 is larger than the spring force of the compression coil spring 85, with the result that the first arm 73 of the latch 69 is normally kept in resilient abutment against an outer circumference of the cylindrical member 35.

A frame 84 for regulating vertical movement of the ink pad unit 45 is provided below the ink pad unit 45. The frame 84 is fixed to the housing 1 in such a manner that a side peripheral portion of the frame 84 is mounted to a lower end portion of the housing 1. The frame 84 has a central aperture 88 that is smaller than that of the ink pad 51.

Figure 6:
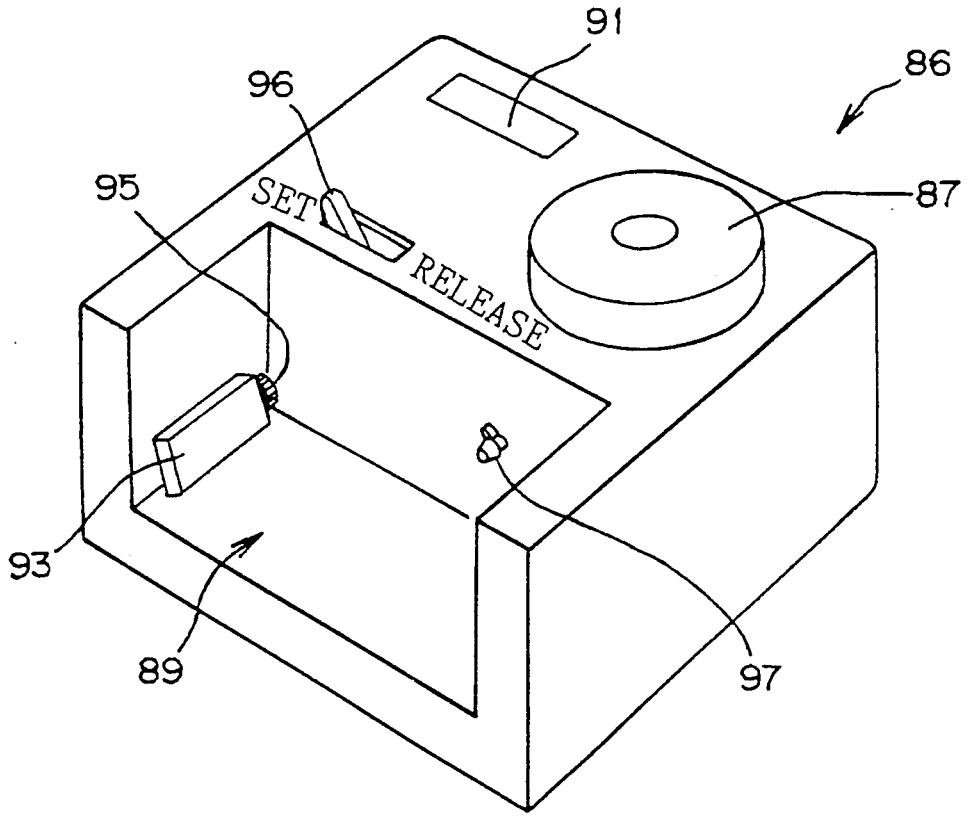
FIG. 6 is a perspective view of the plate making device of the stamp device.

A plate making device 86 of the stamp device, for making a pattern of pores by the application of heat to the stencil paper 3, mounted in the printing element, is shown in FIG. 6. Desired characters, figures and/or symbols of pores are formed in the stencil paper 3 passing between the plate making device 86 and the stamp device as described below. As shown in FIG. 6, the plate making device 86 comprises an input section 87 for inputting data of the desired characters, figures and/or symbols and a release lever 96 for selecting one of a set position and a release position between the plate making device 86 and the stamp device, a liquid crystal display 91 having a predetermined number of columns on an upper face, for displaying the data input by the input section 87, and a plate making section 89 for receiving the printing element and making the pattern of pores formed by application of heat to the stencil paper 3.

In the input section 87, characters and symbols are marked on the upper surface of the character selecting dial in a circumferential arrangement. For example, a mark indicating a desired character is set at a predetermined position by turning the character selecting dial. The plate making device 86 has recessed portion for detachably holding the printing element.

The thermal head 93, as a heating means, is disposed at a position, confronting the platen 21 in the printing element, in the recessed portion, and a stencil paper feeding gear 95 is disposed at a position confronting the platen driving gear 22 of the printing element. A side wall of the recessed portion in the plate making section 89 is provided with a take-up spool driving cam 97. As shown in FIG. 1, the thermal head 93 and the stencil paper feeding gear 95 are adapted to move into contact with or away from the platen 21 and the platen driving gear 22 of the printing-element, respectively, in association with the selection of either a set position or a release position of the release lever 96.

Figure 18:
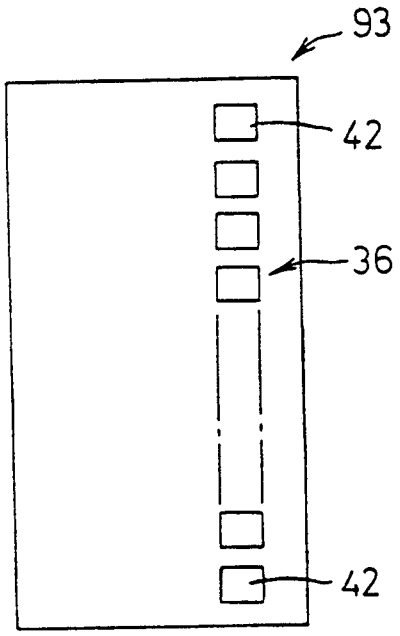
FIG. 18 is a front view of a thermal head.

Referring to FIG. 18, the thermal head 93 has a plurality of heating elements 42 which are arranged in a row 36 along the direction perpendicular to the stencil paper feed direction. The number of the heating elements 2 is 448 with, in this embodiment, eight thermal elements per millimeter. The heating elements 42 are driven selectively in synchronism with the feed of the stencil paper 3 to form pores in the stencil paper 3 by thermal punching according to input data input by the input section 87 (FIG. 6).

In FIG. 1, a contact position of the thermal head 93 and the stencil paper feeding gear 95 with respect to the platen 21 and the platen driving gear 22 is shown by a solid line, while a separate position is shown by a phantom line. The take-up spool driving cam 97 is adapted to engage with the take-up spool 7. When the thermal head 93 comes into contact with the platen 21 with the stencil paper 3 passing therebetween, a current is supplied to the thermal head 3 to thermally perforate the thermoplastic film 9 of the stencil paper 3. Both the stencil paper feeding gear 95 and the take-up spool driving cam 97 are adapted to be driven by a stencil paper feed motor 34. The stencil paper feeding gear 95 is adapted to mesh with the platen driving gear 22 to feed the stencil paper 3 by a predetermined distance. The take-up spool driving cam 97 is adapted to apply to the take-up spool 7 a winding torque for winding the stencil paper 3 fed by the platen driving gear 22.

Figure 19:
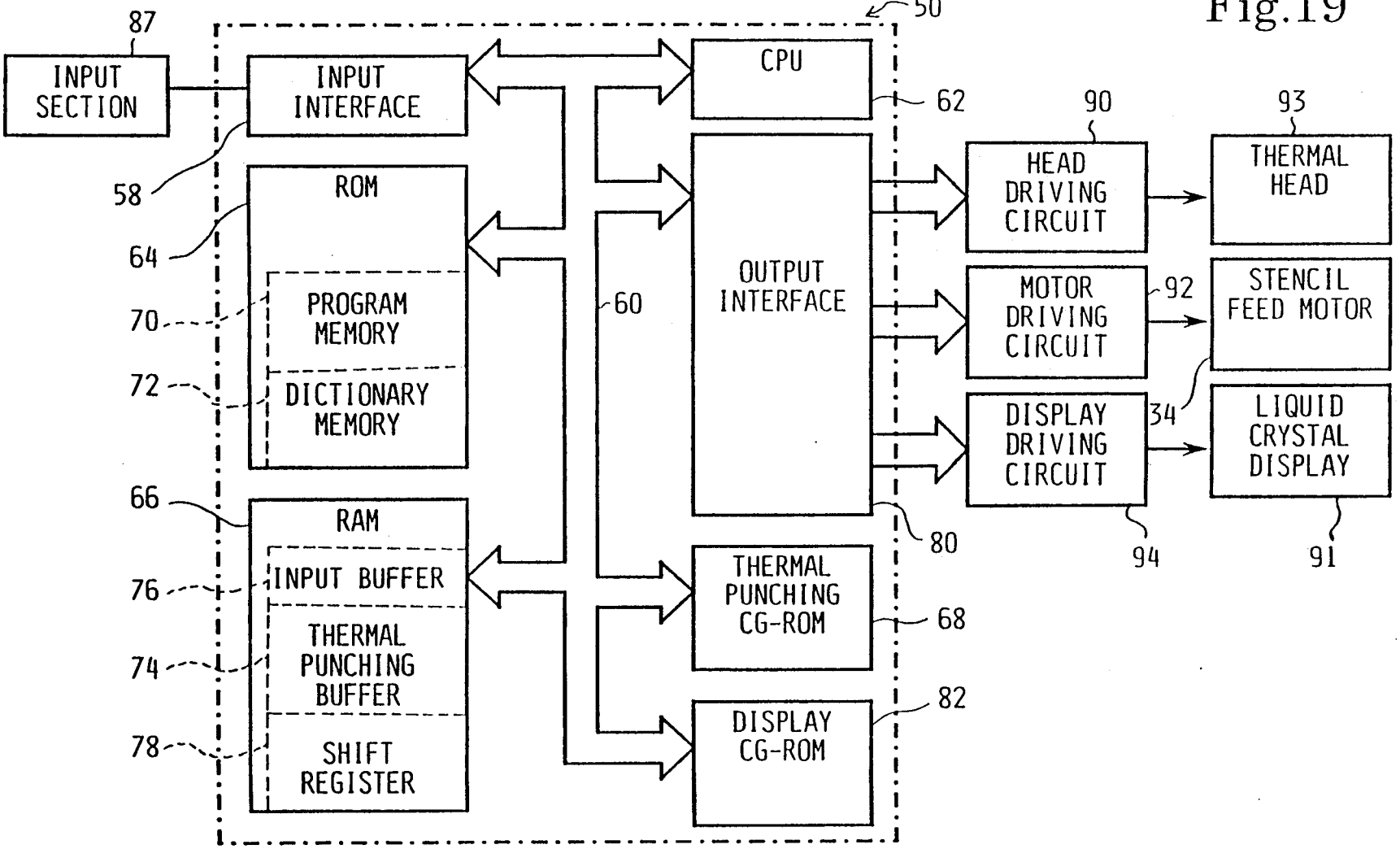
FIG. 19 is a block diagram of a control system incorporated into the stamping device.

Electrical control of the plate making device 86 for making a pattern of pores formed by heating application of the thermal head 93 on the stencil paper 3 and feeding the stencil paper 3 is carried out by a control section included in the frame and shown in FIG. 19. The control section is connected to the input section 87 through an input interface 58 of a microcomputer 50, the latter functioning as a control means. The input interface 58 is connected by a bus 60 to a CPU 62 for controlling the stamp device, a ROM 64 for storing a control program, as shown in FIG. 19, a RAM 66 that functions as a storage means, a thermal punching character generator 68 (hereinafter referred to as "thermal punching CG-ROM") for generating characters for thermal punching by the thermal head 93, a display character generator 82 (hereinafter referred to as "display CG-ROM") for generating characters for the display 91, and an output interface 80.

The ROM 64 has a program memory 70 for storing programs to control the operation of the stamp device, and a dictionary memory 72 for kana-kanji or other appropriate conversions. The RAM 66 has counters (not shown) in addition to an input buffer 76, a thermal punching buffer 74 and a shift register 78.

The thermal punching CG-ROM 68 generates a dot pattern for thermal printing on the basis of input character code data. The display CG-ROM 82 generates a dot pattern to be displayed on the display 91 on the basis of input character code data.

A thermal head driving circuit 90, a motor driving circuit 92 and a display driving circuit 94 are connected to the output interface 80. The thermal head 93, the stencil paper feed motor 34 and the display 91 are connected respectively to the thermal head driving circuit 90, the motor driving circuit 92 and the display driving circuit 94.

Figure 20:
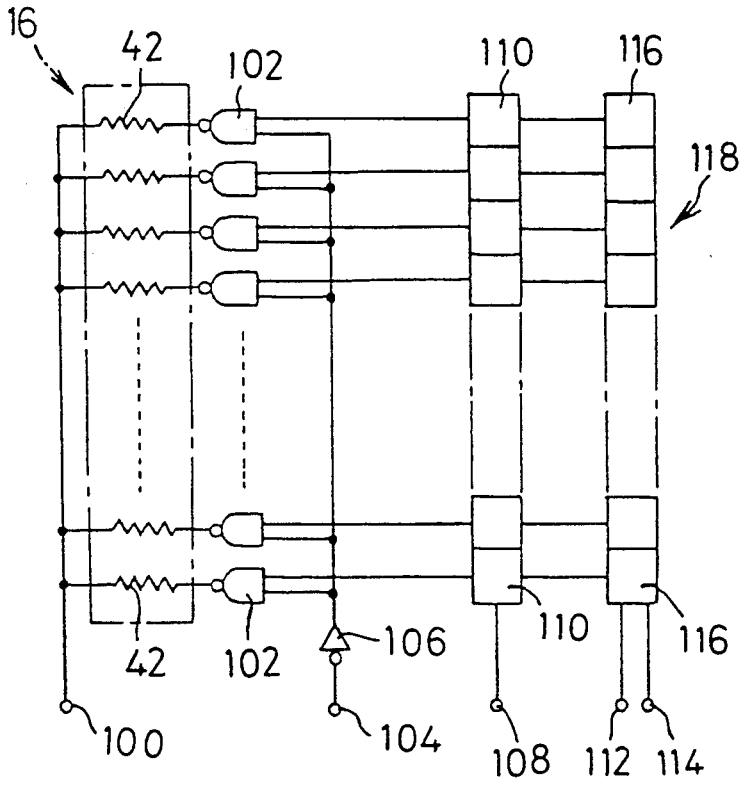
FIG. 20 is a circuit diagram of a thermal head driving circuit.

FIG. 20 shows the thermal head driving circuit 90. One of the electrodes of each of the heating elements 42 is connected to a power feed terminal 100 connected to the positive terminal of a 12 volt power supply. The other electrode of the power supply is connected to a ground of a driver 102. The output terminal of an inverter 106 has an input terminal connected to a thermal punching strobe input terminal 104 and the output terminal of a data latch circuit 110 has an input terminal which is connected to a latch signal input terminal 108. The other input terminal of the thermal punching drivers 102 are connected to an associated data latch circuit 110. The input terminal of each data latch circuit 110 is connected to the output terminal of a shift register 116 having input terminals connected respectively to a data input terminal 112 and a clock input terminal 114.

The control section orders that print data representing characters to be printed as stored in the shift registers 116 in synchronism with a clock signal. Upon the reception of a latch signal by the data latch circuits 110, the print data stored in the shift registers 116 are applied to and stored in the corresponding data latch circuits 110 and, at the same time, the same print data are applied to the thermal punching drivers 102. In this state, if a thermal punching pulse signal in the 0 state is applied to the input terminal through the thermal punching strobe input terminal 104, a signal in the 1 state is output at the output terminal of the inverter 106 connected to the input terminals of the thermal punching drivers 102. Accordingly, the output terminal of the thermal punching drivers 102 are in the 0 state when the data provided by the data latch circuits 110 are in the 1 state and, consequently, a driving current is supplied through the power feed terminal 100 to the corresponding heating elements 42. The pulse width of the thermal punching pulse signal applied to the thermal punching strobe input terminal 104 is determined so that the heating elements 42 are heated to a surface temperature suitable for thermal punching, for example, a temperature greater than 200° C.

Figure 21:
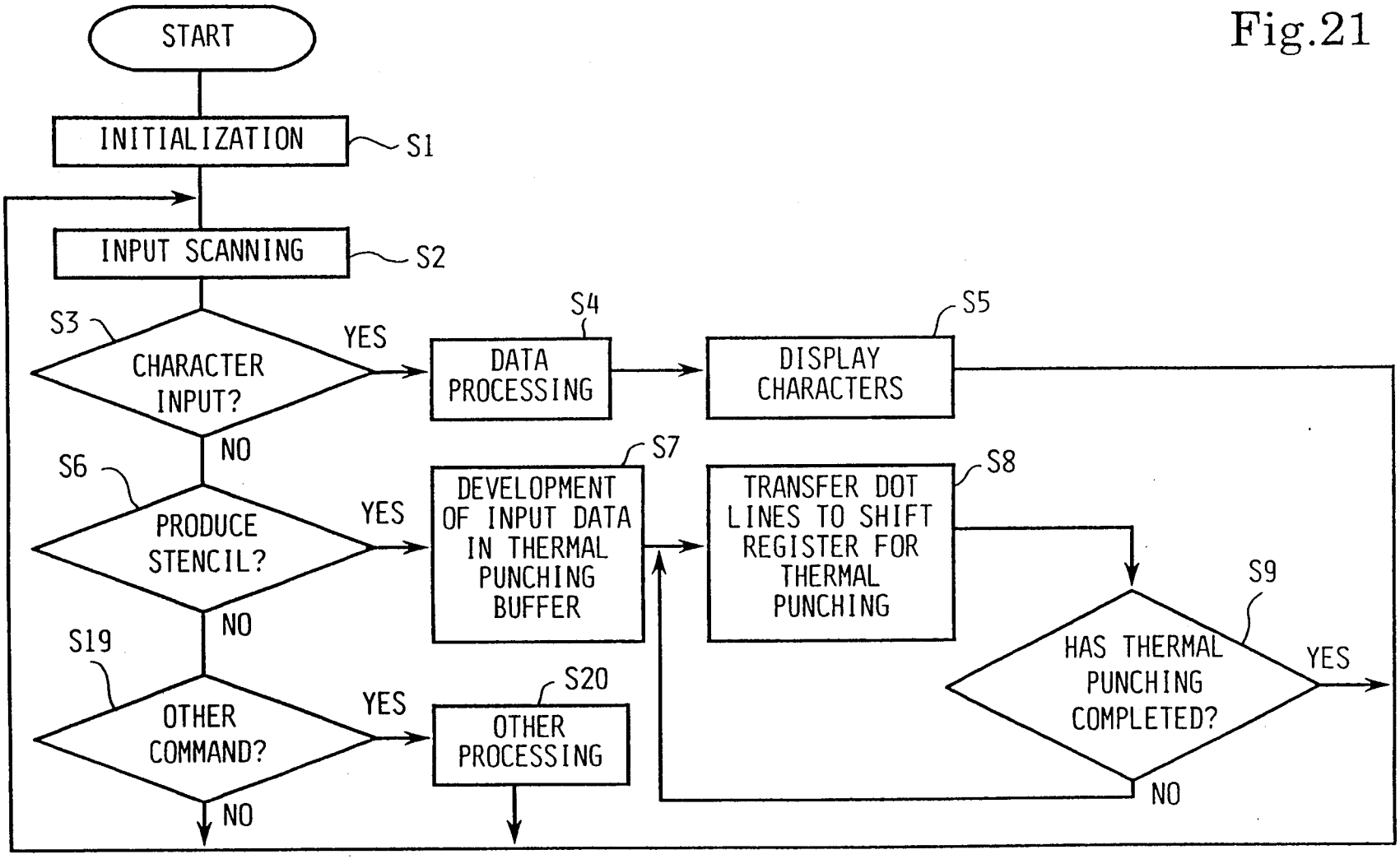
FIG. 21 is a flow chart showing essential steps of a stamping stencil producing program stored in the program memory shown in FIG. 19.

A stamping stencil producing program executed by the control section of the stamp device will be described with reference to FIG. 21.

Upon connection of the stamp device to a power supply, the buffers and the register of the RAM 66 are initialized in step S1. Thermal punching data entered by operating the input section 87 is stored in the input buffer 76 in steps S2, S3 and S4, and then characters corresponding to the thermal punching data are read from the display CG-ROM 82 and are displayed on the display 91 in step S5. When produce stencil is selected using the input section, step S7 is executed after steps S2 and S6 to develop a dot pattern, generated by the thermal punching CG-ROM 68, in the thermal punching buffer 74. Subsequently, dot lines of the dot pattern are transferred one dot line at a time to the shift register 116 and pores corresponding to the dot lines are formed in the stencil paper 3 in step S8. A query is made in step S9 to see if all the pores corresponding to the thermal punching data have been formed. If the response in step S9 is negative, steps S8 and S9 are repeated. Thus, the dot pattern is formed in the stencil paper by the row 36 of the 448 heating elements 42. If produce stencil has not been selected in step S6, then the control section determines whether another action, such as stencil paper advance, has been input using the input section 87. If so, the process is executed. The stamping device thus executes the stamping stencil producing program to form the desired character string on the stencil paper 3.

The control section is disclosed in U.S. patent application Ser. No. 07/811,974, concurrently filed Dec. 23, 1991, to TAKASHI MIKI AND TETSUJI FUWA and entitled "STAMP DEVICE EMPLOYING A HEAT SENSITIVE STENCIL PAPER TO BE PERFORATED BY HEAT OF A THERMAL HEAD", the disclosure of which is incorporated herein by reference.

The operation of the stamp device as constructed above will now be described. As previously mentioned, FIG. 1 shows a first position of the printing element where the ink pad 51 is separated from the stencil paper 3, and the printing element is mounted to the plate making device 86. (shown in part). In this condition, the thermal head 93 is in pressure contact with the platen 21, through the stencil paper 3, and the stencil paper feeding gear 95 is in mesh with the platen driving gear 97.

First, print information is input from the input section 87 of the plate making device 86, and a print start command is finally input. In response to the print start command, the stencil paper feeding motor is driven to rotate. A torque of the motor is transmitted through the stencil paper feeding gear 95 to the platen driving gear 22, thereby rotating the platen 21 in the clockwise direction as viewed in FIG. 1. Since the stencil paper 3 is sandwiched, under pressure, between the platen 21 and the thermal head 93, the stencil paper 3 is fed by a frictional force between the thermal head 93 and the platen 21. At this time, a back tension is applied to the stencil paper 3 in a direction reverse to a feeding direction thereof by a frictional force between the stencil sheet 3 and the felt 17.

The thermal head 93 is controlled to be electrically heated at a predetermined timing according to the print information by a control section, as discussed above, in the plate making device 86, so that portions (dots) of the thermoplastic film 9 of the stencil paper 3 are melted by the heat of the thermal head 93, thereby forming a predetermined perforation image on the stencil paper 3. The stencil paper 3 fed from the platen 21 is wound around the take-up spool 7 by a winding torque transmitted through the take-up driving cam 97 to the take-up spool 7. This winding torque is generated by a known slip mechanism (not shown) interposed between the stencil paper feeding motor and the take-up spool driving cam 97. Accordingly, the stencil paper 3 is wound around the take-up spool 7 by an amount equal to a feeding amount generated by the platen 21. After the predetermined perforation image is formed on the stencil paper 3 by the heat of the thermal head 93, a perforation image formed area of the stencil paper 3 is fed to a position centered on the aperture 88 of the frame 84.

Figure 7:
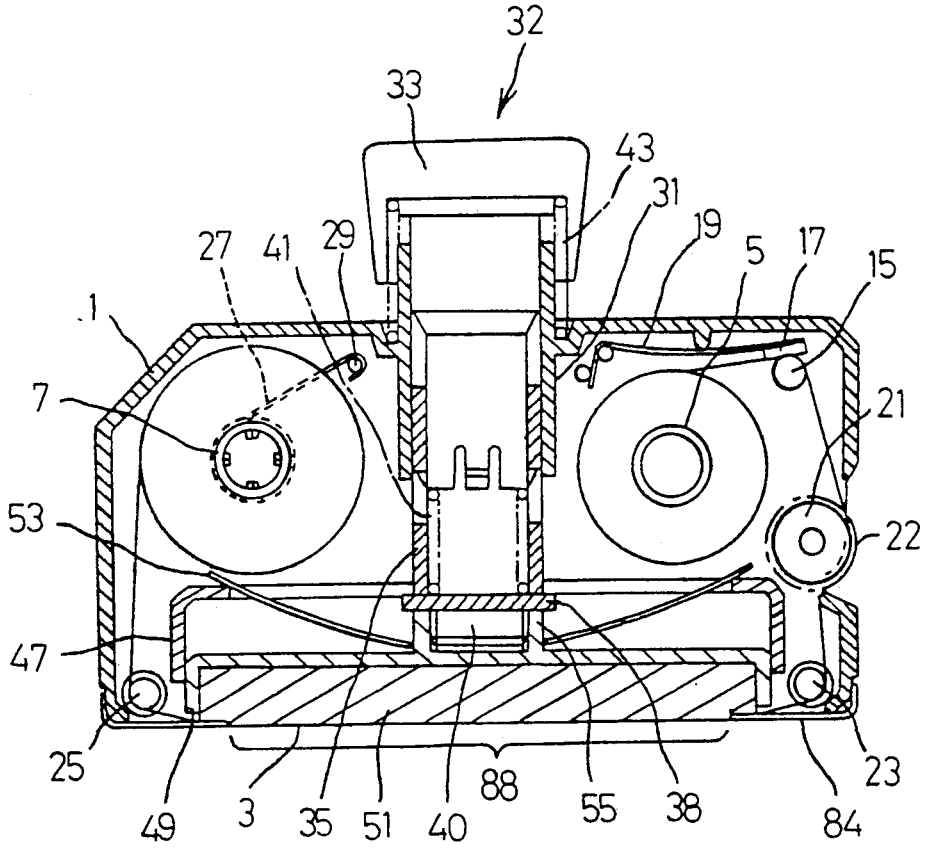
FIG. 7 is a side elevation in vertical section of the printing element illustrating the ink impregnating member in close contact with the heat sensitive stencil paper.
Figure 8:
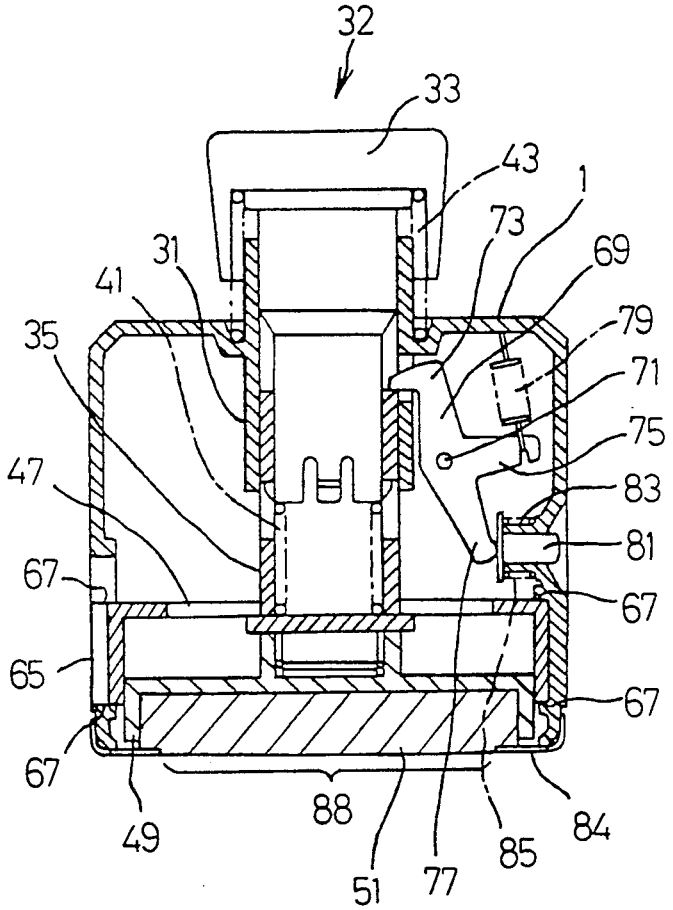
FIG. 8 is a front elevation in vertical section of the printing element shown in FIG. 7.

After the plate making in the stamp device is completed, the grip portion 33 of the printing element is depressed downwardly to move the ink pad 51 to a second position where the ink pad 51 closely contacts the stencil paper 3 as shown in FIGS. 7 and 8. More specifically, when the grip portion 33 is depressed downwardly against the spring force of the compression coil spring 43, the cylindrical member 35, guided by the cylindrical guide 31 as shown in FIG. 2, is urged downwardly by the compression coil spring 41. Because the ink pad holder 49 is connected with the cylindrical member 35, by the engagement between the thread portions 40 and 55, the ink pad holder 49 is lowered by the lowering of the cylindrical member 35 counter to the spring force of the leaf spring 53, as the ink pad holder 49 is guided by the side wall portion of the ink pad cartridge 47. In this manner, the ink pad 51 comes into close contact with the stencil paper 3.

Thereafter, when the cylindrical member 35 is further lowered from the position establishing contact between the ink pad 51 and the stencil paper 3, a peripheral portion of the ink pad 51 comes into contact with the frame 84 through the stencil paper 3. When the cylindrical member 35 is further lowered from this position, the peripheral portion of the ink pad 51 is compressed by the frame 84, and an upper end of the cylindrical member 35 reaches the first arm 73 of the latch 69.

As a result, the latch 69 is rotated, by force from the tension coil spring 79, in the counterclockwise direction, as viewed in FIG. 8, and the first arm 73 of the latch 69 is brought into engagement with the upper end of the cylindrical member 35. The spring force of the tension coil spring 79 is larger than the sum of the spring force of the compression coil spring 43 acting to lift the cylindrical member 35 and the spring force of the leaf spring 53 acting to lift the ink pad holder 49. Therefore, the latch 69 is securely engaged with the upper end of the cylindrical member 35 rather than being forced back by the compression coil spring 43 and the leaf spring 3. The first arm 73 of the latch 69 and the upper end of the cylindrical member 35 function as a retaining means for retaining contact between the ink pad 51 and the stencil paper 3. In this condition, a peripheral portion of the perforation image formed area of the stencil paper is pressed between the frame 84 and the ink pad 51. Therefore, the stencil paper 3 is substantially prevented from slipping between the frame 84 and the ink pad 51. The above-mentioned operation is carried out while the printing element is mounted on the plate making device 86.

Figure 9:
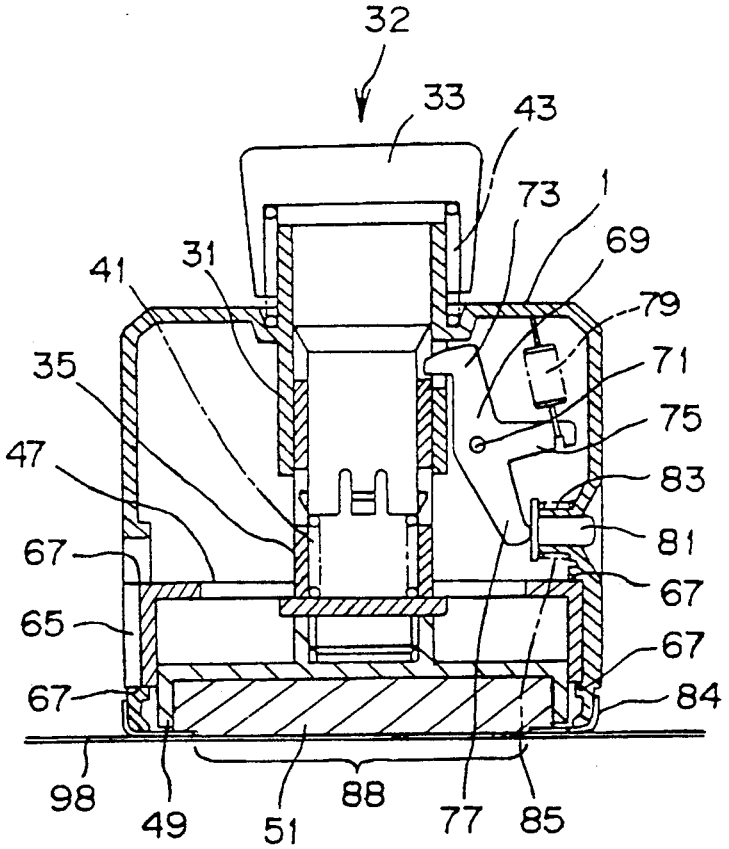
FIG. 9 is a front elevation in vertical section of the printing element illustrating printing.

Then, the release lever 96, shown in FIG. 6, is moved to the release position to thereby separate the thermal head 93 and the stencil paper feeding gear 95 from the platen 21 and the platen driving gear 22, respectively, so that the printing element may be removed from the plate making device 86. Thereafter, as shown in FIG. 9, the printing element is placed at a desired printing position such that the perforation image formed area of the stencil paper 3 is opposed to the desired printing position on the printing paper 98. In this position, when the grip portion 33 is further depressed, the compression coil spring 41 in the cylindrical member 35 is compressed, and the ink pad 51 contacting the printing paper 98 through the stencil paper 3 is accordingly elastically deformed by the spring force of the compression coil spring 41 according to a compression quality thereof. When the grip portion 33 is further depressed from this position, an inside upper end of the grip portion 33 comes into abutment against an upper end of the cylindrical guide 31 of the housing 1 with the result that further depression of the grip portion 33 is prevented.

In the above position, the ink pad 51 is elastically deformed by a predetermined amount according to the spring force of the compression coil spring 41. Accordingly, the ink held in the ink pad 51 is forced therefrom in an amount corresponding to an elastic deformation amount of the ink pad 51 to pass through the perforated portion of the stencil paper 3 onto the printing paper 98. Thus, a transferred image on the printing paper 98 is obtained that corresponds to the perforated image formed on the stencil paper 3.

At this time, the grip portion 33 is in contact with the upper end of the cylindrical guide 31 of the housing Therefore, any further depression force applied to the grip portion 33 is merely transferred through the housing 1 and the frame 84 to the printing paper 98. That is, excessive elastic deformation of the ink pad 51 beyond the predetermined quantity is prevented. Accordingly, it is possible to prevent a deterioration in print quality due to excessive ink being forced from the ink pad 51. Further, as the ink pad 51 is formed of an elastic material, it can be readily deformed to follow any unevenness of the printing paper 98, thus preventing the occurrence of a local blur. Moreover, as the compression coil spring 41 is interposed between the grip portion 33 and the ink pad 51, a uniform pressure can be applied to the printing paper 98.

According to the stamp device described above, after a number of sheets of paper are printed using the same plate and it deteriorates, or a different pattern is desired, printing can be continued using a new plate. In this case, before mounting the printing element to the plate making device 86 to make the new plate, the ink pad 51 is moved from the second position where the ink pad 51 is in close contact with the stencil paper 3 to the first position where the ink pad 51 is separated from the stencil paper 3. More specifically, referring to FIG. 8, the button key 81 is depressed against the spring force of the tension coil spring 79 to thereby rotate the latch 69 in the clockwise direction and disengage the latch 69 from the upper end of the cylindrical member 35.

As a result, the ink pad holder 49 is lifted by the spring forces of the compression coil spring 43 and the leaf spring 53 until the upper surface of the ink pad holder 49 comes into abutment against the lower surface of the ink pad cartridge 47. In this manner, the depression of the button key 81 causes the ink pad 51 to move to the first position where the ink pad 51 is separated from the stencil paper 3. Then, the printing element is mounted to the plate making device 86 with the release lever 96 of the plate making device 86 in the release position. Then, the release lever 96 is moved to the set position, thereby making ready the plate making device 86 to make a new plate described above.

According to the stamp device described above, color change and replenishment of the ink can be easily carried out by exchanging the ink pad unit 45. Such an exchange will be described with reference to FIGS. 1 and 10.

Figure 10:
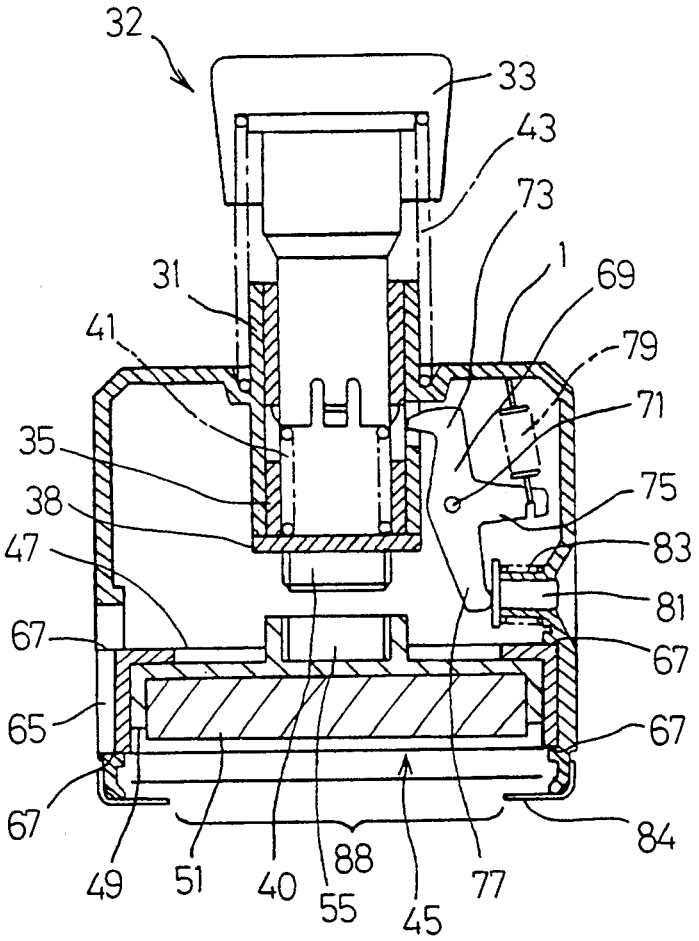
FIG. 10 is a front elevation in vertical section of the printing element illustrating the position where the ink pad unit can be exchanged.

Referring to FIG. 1, the grip portion 33 is first rotated in the counterclockwise direction to disengage the external thread portion 40 of the cylindrical member 35 from the internal thread portion 55 of the ink pad holder 49. As a result, the grip unit 32 is lifted by the spring force of the compression coil spring 43 to upwardly move the cylindrical member 35 until an upper surface of the flange 38 comes into abutment against a lower end of the cylindrical guide 31 of the housing 1. This position is shown in FIG. 10. As shown in FIG. 10, the ink pad unit 45, which has been separated from the grip unit 32, can be drawn leftwardly through the opening 65 of the housing 1. Thus, the ink pad unit 45 can be removed. Further, installation of the ink pad unit 45 is carried out in the reverse order to that of the removal.

As discussed above, with the stamp device of this preferred embodiment, the ink pad unit 45 can be exchanged very simply so that operator's hands or clothes are not stained by the ink during a change in the color of the ink or a replenishment of the ink.

It should be noted that the invention is not limited to the above preferred embodiment, but may be embodied in various modes without departing from the scope of the invention. For instance, while the second position of the ink pad 51 tightly contacting the stencil paper 3 is maintained by the engagement of the latch 69 with the cylindrical member 35, and printing is effected by further depressing the grip portion 33 in the above preferred embodiment, the latch 69 may be removed, and the printing may be effected when the ink pad 51 is moved to the second position where the ink pad 51 tightly contacts the stencil paper 3.

A second embodiment will be described in reference to FIGS. 11 and 12.

The main difference between the first embodiment and the second embodiment is the mechanical structure of the plate making device 86 of the first embodiment has been modified. In particular, a latch release bar 99 is provided, on the side wall of the plate making device 86 of the second embodiment, for releasing the button key 81. Therefore common elements between the first embodiment and the second embodiment are designated by the same reference numbers and labels and the detailed explanation relating to the common elements will be omitted.

Figure 11:
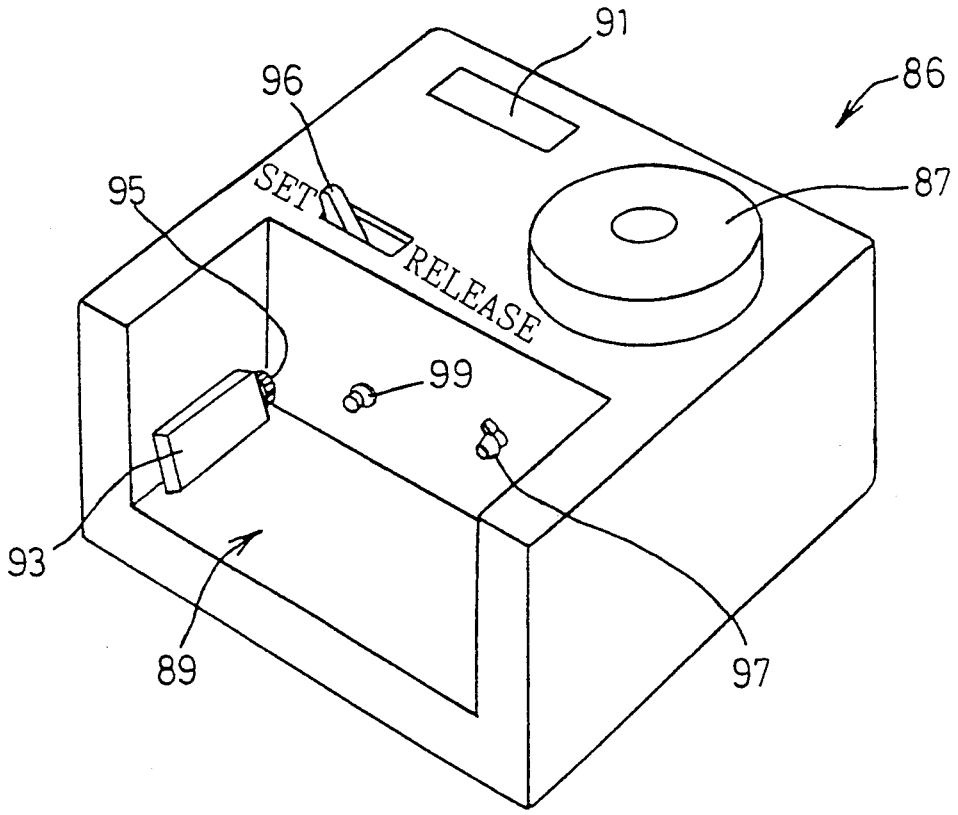
FIG. 11 is a perspective view of a plate making device in a second embodiment.
Figure 12:
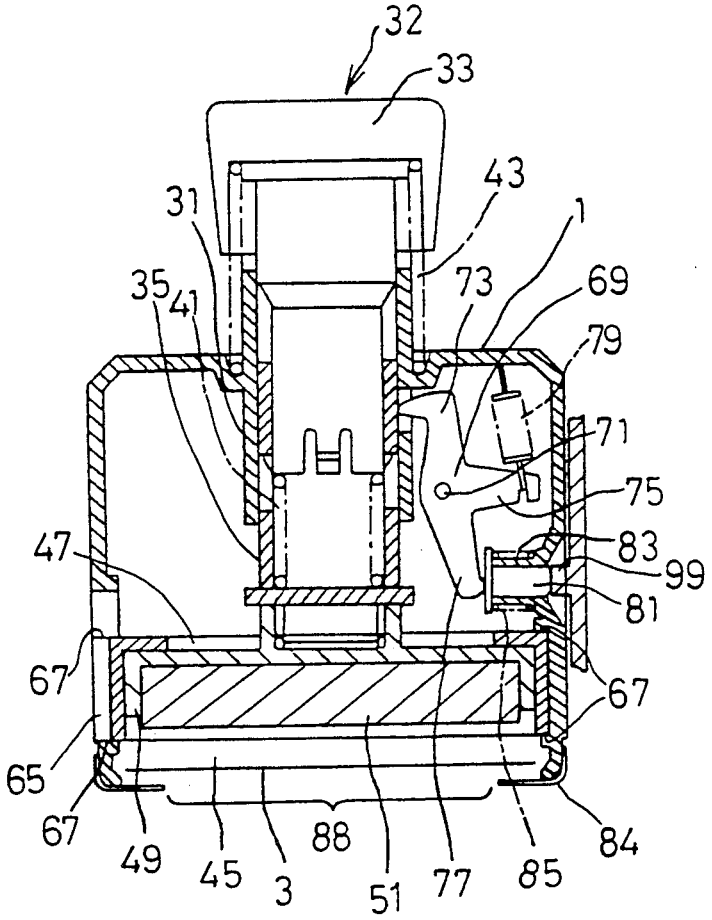
FIG. 12 is a front elevation in vertical section of the printing element and a portion of the plate making device in the second embodiment.
Figure 13:
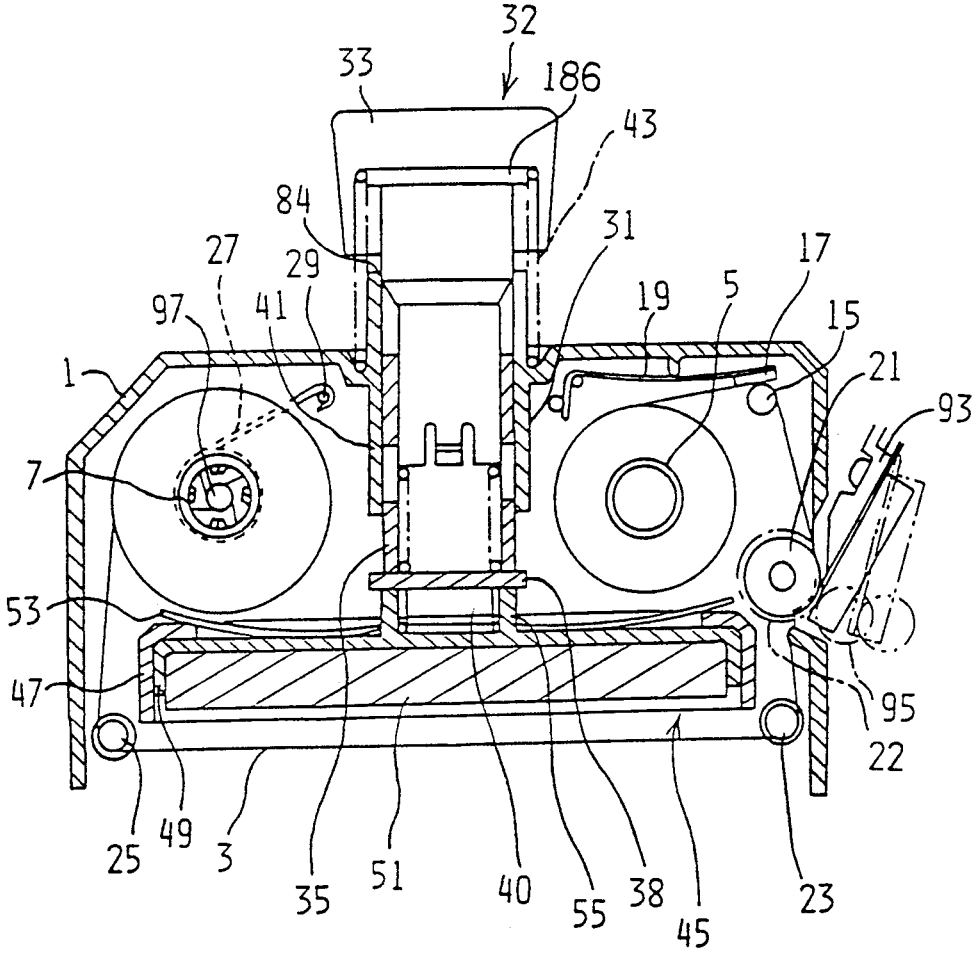
FIG. 13 is a side elevation in vertical section of the printing element illustrating a condition where the ink impregnating member is separate from the heat sensitive stencil paper in the third embodiment.
Figure 14:
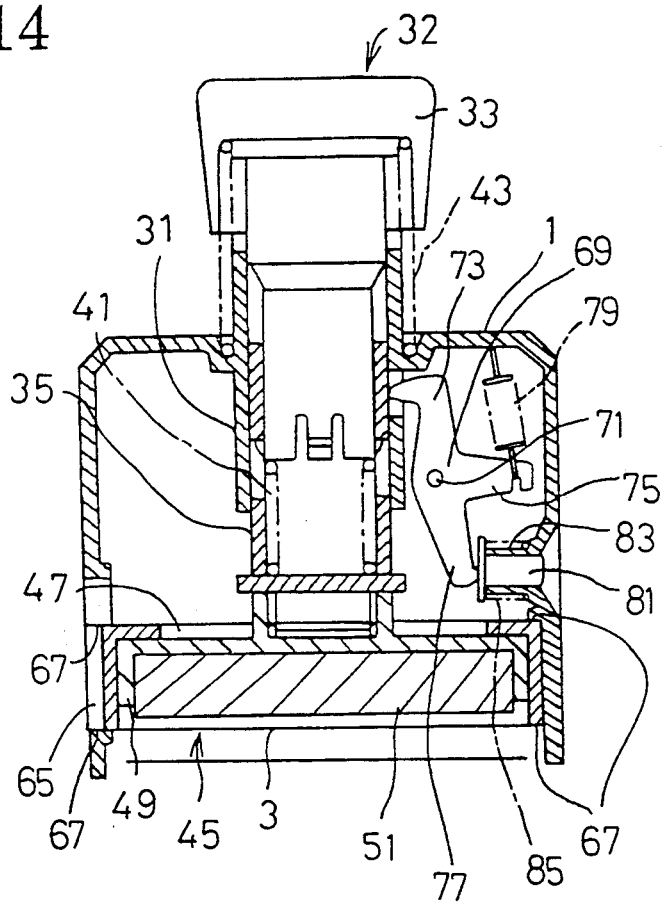
FIG. 14 is a front elevation in vertical section of the printing element of the third embodiment shown in FIG. 13.

As shown in FIG. 11, the release bar 99, which functions as a retention releasing means, is provided at an engaging position, opposing the releasing button key 81 when the stamp device is mounted on the plate making device 86 on the side wall of the plate making device 86.

According to the stamp device, after a plurality of sheets of paper are printed using the same plate, printing can then be carried out using a new plate.

In this case, in the first embodiment, before mounting the printing element to the plate making device 86 to make the new plate, the ink pad 51 must be moved from the second position where the ink pad 51 is in close contact with the stencil paper 3 to the first position where the ink pad 51 is separated from the stencil paper 3. To do so, the button key 81 is depressed, against the spring force of the tension coil spring 79, to thereby rotate the latch 69 in the clockwise direction and disengage the latch 69 from the upper end of the cylindrical member 35.

As a result, the ink pad holder 49 is lifted by the spring forces of the compression coil spring 43 and the leaf spring 53 until the upper surface of the ink pad holder 49 comes into abutment against the lower surface of the ink pad cartridge 47. In this manner, the depression of the button key 81 causes the ink pad 51 to move to the first position where the ink pad 51 is separate from the stencil paper 3.

However, with the second embodiment, if the operator erroneously fails to depress the button key 81 before mounting the printing element to the plate making device 86, the latch release bar 99, in the plate making device 86, depresses the button key 81 upon mounting the printing element so that the ink pad 51 is reliably moved to the second position where the ink pad 51 is separate from the stencil paper 3.

In both embodiments, the printing element is mounted to the plate making device 86 with the release lever 96 of the plate making device 86 in the release position. Then, the release lever 96 is moved to the set position, thereby obtaining the ready condition of the plate making device 86 as discussed above. At this time, the new plate is made in the stamp device by using the plate making device 86. Accordingly, there is no possibility, in the second embodiment, that the stencil paper 3 is fed under the condition where it remains in close contact with the ink pad 51 thereby avoiding problems such as a defective feed or breakage of the stencil paper 3.

A third embodiment will be described in reference to FIGS. 13–17.

Figure 15:
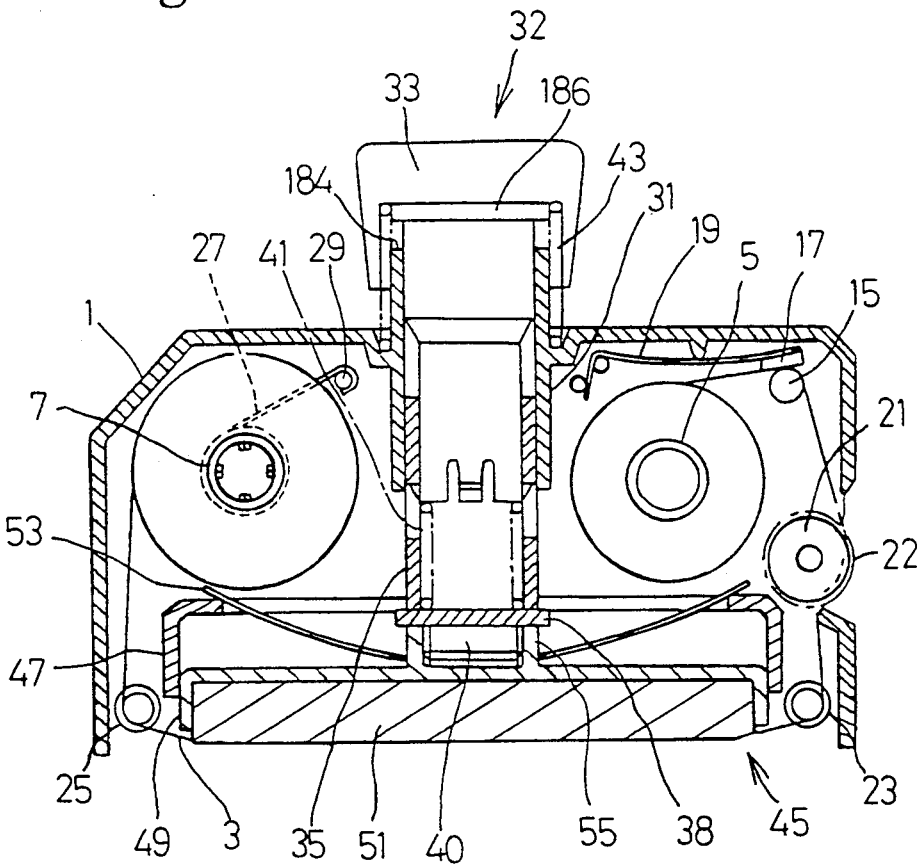
FIG. 15 is a side elevation in vertical section of the printing element illustrating the point where the ink impregnating member is in close contact with the heat sensitive stencil paper in the third embodiment.
Figure 16:
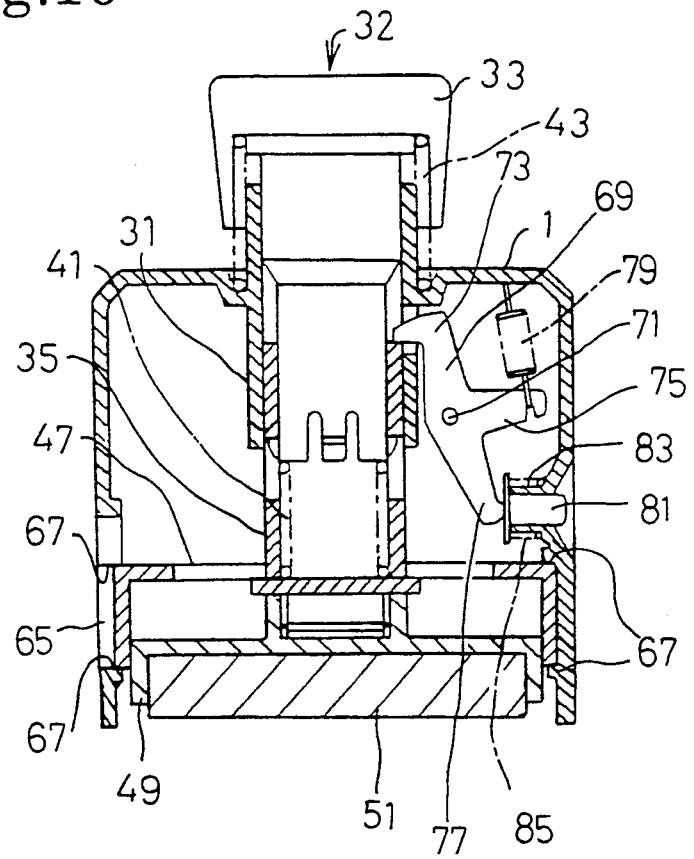
FIG. 16 is a front elevation in vertical section of the printing element shown in FIG. 15 in the third embodiment.
Figure 17:
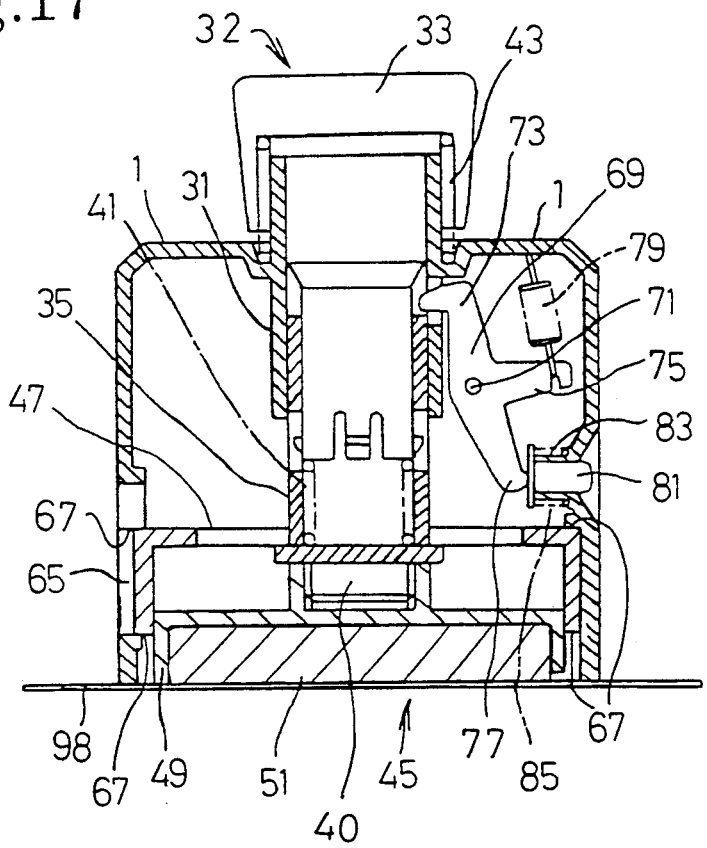
FIG. 17 is a front elevation in vertical section of the printing element illustrating a printing condition in the third embodiment.

The main difference between the first embodiment and the third embodiment is in the regulating member for regulating amount of vertical movement of the grip unit 32 as shown in FIG. 15. The common elements between the first embodiment and the third embodiment are designated by the same reference numbers and labels and a detailed explanation relating to the common elements is omitted.

In the first embodiment, the frame 84 is fixed to the housing 1 in such a manner that a side peripheral portion of the frame 84 is mounted to a lower end portion of the housing 1. However, the frame 84 is not fixed to the housing 1 in the third embodiment. Rather, the movement limit for the grip unit 32 is provided by making an inner end surface 186 of the grip 33 abut against an upper end surface 184 of the cylindrical guide 31 of the housing 1, so that the grip unit 32 is not permitted to move beyond a predetermined point.

The ink pad 51 is further moved from a second position where the ink pad 5 is in close contact with the stencil paper 3 to a third position where the ink pad 51 is pressed under a predetermined pressure against the recording medium 98 through the stencil paper 3. At this time, the movement of the ink pad 51 is limited at the third position by both the upper end surface 184 of the cylindrical guide 31 and the inner end surface 186 of the grip 33 which function as the limiting means. Thus, the ink pad 51 is compressed by a predetermined amount when in the third position. Accordingly, ink in the ink pad 51 is forced therefrom to penetrate the perforated portion of the thermoplastic film of the stencil paper 3 to produce a transferred image on the recording medium 98 corresponding to the perforation image formed in the stencil paper 3. The grip 33 is not permitted to move downwardly beyond a predetermined point by the abutment of the grip 33 against the upper end surface 184 of the cylindrical guide 31 of the housing 1. That is, excessive compression of the ink pad 51 beyond a predetermined point is prohibited. Accordingly, there is no possibility that excessive ink is squeezed from the ink pad 51 to thereby cause a deterioration in the print quality.

Although the invention has been described in its preferred forms with a certain degree of particularity, obviously many changes and variations are possible therein. It is therefore to be understood that the invention may be practiced otherwise than as specifically described herein without departing from the scope and spirit of the invention.

What is claimed is:

1. A stamp device employing a heat sensitive stencil paper which has a pattern of pores formed by application of heat, comprising:

a printing element comprising, a housing; first and second rollers rotatably mounted in the housing;

an elongated heat sensitive stencil paper having an end wound around said first roller and a lead end for winding around said second roller;

an ink supplying means for supplying an ink to the pattern of pores of the heat sensitive stencil paper, said ink supplying means being provided in a feeding path of the heat sensitive stencil paper between the first roller and the second roller; and moving means for moving said ink supplying means between a first position where the ink supplying means is separated from the heat sensitive stencil paper and a second position where the ink supplying means is in close contact with the pattern of pores of the heat sensitive stencil paper; and a plate making device having stencil paper feeding means for drawing the heat sensitive stencil paper from the first roller and feeding the heat sensitive stencil paper to the second roller, said stencil paper feeding means for feeding the pattern of pores of the heat sensitive stencil paper to a position between the first and second rollers.

2. The stamp device as claimed in claim 1, wherein the heat sensitive stencil paper has a laminate structure including a thermoplastic layer film and a porous carrier layer.

3. The stamp device as claimed in claim 2, wherein a thickness of the thermoplastic film ranges from 1 micron to 4 microns.

4. The stamp device as claimed in claim 1, wherein said ink supplying means comprises an elastic ink impregnated means.

5. The stamp device as claimed in claim 4, wherein said ink impregnated means is formed of an elastic material that may be readily deformed according to an unevenness of the heat sensitive stencil paper.

6. The stamp device as claimed in claim 1, wherein the printing element further comprises a tension applying member that abuts the elongated heat sensitive stencil paper drawn from the first roller in order to apply frictional force thereon.

7. The stamp device as claimed in claim 1, wherein the printing element comprises a torsion coil spring fixed at one end to the housing and wound around the second roller at an opposite end in such a manner that the torsion coil spring slackens during clockwise rotation and tightens during counterclockwise rotation.

8. The stamp device as claimed in claim 7, wherein when the second roller is rotated in a feeding direction of the heat sensitive stencil paper, a load applied to the second roller by the torsion coil spring is small, while when the second roller is rotated in an opposite direction of the heat sensitive stencil paper, the load applied to the second roll by the torsion coil spring is large.

9. The stamp device as claimed in claim 1, wherein said moving means comprises a grip unit further comprising a grip portion, a cylindrical member, means for engagement of the cylindrical member with the grip portion, and a compression coil spring disposed between the cylindrical member and the grip portion.

10. The stamp device as claimed in claim 9, wherein relative rotation between the grip portion and the cylindrical member around a common axis is inhibited by the means for engagement and relative axial movement of the grip portion and the cylindrical member along the common axis is permitted.

11. The stamp device as claimed in claim 10, wherein an ink pad unit is coupled to the cylindrical member of the grip unit, said ink pad unit comprising said ink supplying means.

12. The stamp device as claimed in claim 11, wherein the ink pad unit comprises an ink pad cartridge, and ink pad holder movably mounted int he ink pad cartridge, an ink impregnated member bonded to the ink pad holder, and a leaf spring mounted on a side of the ink pad holder reverse to a side where the ink impregnated member is bonded, said leaf spring permitting movement of the ink pad holder relative to the ink pad cartridge.

13. The stamp device as claimed in claim 10, wherein an ink pad unit is detachably coupled with the cylindrical member of the grip unit.

14. The stamp device as claimed in claim 1, further comprising retaining means for retaining said ink supply means in contact with the heat sensitive stencil paper.

15. The stamp device as claimed in claim 14, further comprising releasing means for releasing said retaining means.

16. The stamp device as claimed in claim 15, further comprising a latch pivotally mounted to the housing having at least two arms, a first arm and a second arm, said first arm of said latch functioning as said retaining means and said second arm of said latch engaging with said releasing means.

17. The stamp device as claimed in claim 1, wherein said a plate making device forms a perforation image on said heat sensitive stencil paper, said plate making device having an opening for removable receiving the printing element.

18. The stamp device as claimed in claim 17, wherein said plate making device comprises an input section for inputting data concerning desired characters, figures and symbols and a display for displaying data input by the input section.

19. The stamp device as claimed in claim 17, wherein said plate making device comprises a release lever for selecting one of a contact position and a release position between the plate making device and the printing element.

20. The stamp device as claimed in claim 17, wherein said plate making device comprises a thermal head and a stencil paper feeding member and said printing element further comprises a platen confronting the thermal head through the stencil paper and a platen driving member confronting the stencil paper feeding member with which it is capable of being engaged.

21. The stamp device as claimed in claim 20, wherein said plate making device further comprises a release lever for selecting one of a set position and a release position between the plate making device and the printing element and is structured such that the thermal head and the stencil paper feeding member are one of brought into contact with and separated from the platen and the platen driving member of the stamp device in accordance with the respective selection of the set position and the release position of the release lever.

22. The stamp device as claimed in claim 17, wherein said plate making device comprises retention releasing means for releasing the holding of said ink supplying means in contact with the sensitive heat stencil paper by said retaining means when said printing element is mounted to said plate making device.

23. The stamp device as claimed in claim 1, further having a third position where said ink supplying means is pressed under a predetermined pressure against a recording medium through the heat sensitive stencil paper.

24. The stamp device as claimed in claim 23, further comprising limiting means for limiting movement of said ink supplying means by said moving means at the third position.

* * * * *